United States Patent [19]

Geis et al.

[11] Patent Number: 4,787,759

[45] Date of Patent: Nov. 29, 1988

[54] PRINT HEAD GAP ADJUSTMENT MECHANISM WITH SKEW COMPENSATION

[75] Inventors: David G. Geis, Niles; Kurt Rothlisberger, Morton Grove, both of Ill.

[73] Assignee: American Telephone and Telegraph Company - AT&T Information Systems, Holmdel, N.J.

[21] Appl. No.: 56,505

[22] Filed: May 29, 1987

[51] Int. Cl.[4] ..... B41J 11/20

[52] U.S. Cl. ..... 400/55; 400/59; 400/354.3

[58] Field of Search ..... 400/55, 56, 57, 58, 400/59, 352, 354, 354.3, 355, 356; 360/104, 105, 107, 109

[56] References Cited

U.S. PATENT DOCUMENTS

| | | | |
|---|---|---|---|
| 1,625,891 | 4/1927 | Hokanson | 400/58 |
| 2,583,636 | 1/1952 | Dobson | 400/58 |
| 3,155,032 | 11/1964 | Antonucci | 400/58 |

FOREIGN PATENT DOCUMENTS

| | | | |
|---|---|---|---|
| 3226730 | 2/1983 | Fed. Rep. of Germany | 400/59 |
| 152975 | 9/1982 | Japan | 400/58 |
| 154091 | 8/1985 | Japan | 400/59 |

*Primary Examiner*—David A. Wiecking
*Attorney, Agent, or Firm*—Algis A. Tirva

[57] ABSTRACT

A printing gap adjustment mechanism compensates for the change in the printing gap variation caused by the relative motion between two side walls of the printer frame supporting a platen and two guide rods slidably supporting a print head. The mechanism includes a compensator rod and a pair of eccentric members rotatably mounted in a compensator plate which is pivotally mounted on one side wall of the printer frame. One end of the compensator rod is frictionally secured to the opposite side wall while the other end is rotatably supported in an opening in the other side wall and is secured to an eccentric mounted to the compensator plate. One of the guide rods supporting the print head is located near the platen and is secured between two eccentric members, one of which is rotatably mounted in the compensator plate and the other is rotatably mounted in the opposite side wall. The other guide rod is secured between the two side walls. When the printing gap becomes distorted due to relative motion between the two side walls, the mechanism senses the distortion and moves the compensator plate which in turn moves the eccentric member to which one end of the guide rod is secured a predetermined distance to restore the desired printing gap.

8 Claims, 5 Drawing Sheets

PRINT HEAD GAP ADJUSTMENT MECHANISM WITH SKEW COMPENSATION

TECHNICAL FIELD

This invention relates to impact printers and more particularly to a mechanism for establishing and adjusting the clearance between the platen and the print head.

BACKGROUND ART

In impact printers, such as daisy wheel printers, wherein formed character elements upon a print wheel are impacted and driven toward a platen by a hammer mechanism, or dot matrix printers wherein characters are formed as selected combinations of reciprocating wires are driven toward a platen, a significant determinant of output print quality is the size of the gap between the surface of the recording medium held against the platen and the impacting element. Deviations from an optimal printing gap will either cause the impression to be too light—if the distance is too great, or may emboss the recording medium—if the distance is too small.

Various methods for effecting the gap adjustment between a print head and a platen are well known in the art. In most serial printers, a print head is slidably mounted on a pair of guide rods which are positioned parallel to the platen and are held in place by having their ends fastened between the left and right side walls of a printer frame. One guide rod is positioned near the platen and passes through an opening in the front portion of the print head. The second guide rod is mounted so as to support the back portion of the print head and passes through an opening in the back portion of the print head, the opening having a shape such as to permit lateral motion between the print head and the guide rod. The guide rod passing through the front portion of the print head is mounted on a pair of eccentrics which permit the rod lateral motion towards and away from the platen. A similar print head mounting arrangement is described in U.S. Pat. No. 4,525,085.

This type of print head mounting arrangement allows for a printing gap to be easily varied to accommodate multiple ply record medium, and as long as there is no relative motion between the two side walls supporting the the two guide rods and the platen, the gap will remain constant across the length of the platen. Prevention of the relative motion between the side walls, however, requires a sturdy printer frame which constitutes a major portion of the weight of the printer. To increase the portability of the printers, as well as to reduce the cost, the weight of the printer frames may be reduced to a point where the frame may not be sturdy enough to prevent relative movement between the two side walls when the printer is placed on anything but a substantially flat surface. Once there is relative motion or skewing between the side walls, the printing gap will vary across the width of the platen. FIG. 2 of the drawing illustrates the ideal condition when a printer is located on a substantially flat surface.

FIGS. 3 and 4 of the drawing show various phases of misalignment between the platen and the print head causing variation of the printing gap therebetween in a printer which is not equipped with the device of the present invention. The structures shown in these figures are described in greater detail later.

DISCLOSURE OF THE INVENTION

In accordance with the present invention, we provide a mechanism which compensates for the change in a printing gap variation caused by the relative motion between two side walls of the printer frame supporting the platen and two guide rods slidably supporting a print head. The mechanism includes a compensator rod and a pair of eccentric members rotatably mounted in a compensator plate which is pivotally mounted on one side wall of the printer frame. One end of the compensator rod is frictionally secured to the other side wall while the other end passes through and is rotatably supported in an opening in the opposite side wall and is frictionally secured to an eccentric mounted in compensator plate. One of the guide rods supporting the print head is located near the platen and is secured between two eccentric members, one of which is rotatably mounted in the compensator plate and the other is rotatably mounted in the opposite side wall. The other guide rod is frictionally secured between the two side walls. When the gap becomes distorted due to relative motion between the two side walls, the mechanism senses the distortion and moves the compensator plate which in turn moves the eccentric member to which one end of the guide rod is secured a predetermined distance to restore the desired printing gap.

THE DRAWINGS

FIG. 2 shows a normal non-distorted relationship;

FIG. 3 shows the effect on the gap when the printer frame is skewed in the direction along the line 3—3 of FIG. 1;

FIG. 4 shows the effect on the gap when the printer frame is skewed in the direction along the line 4—4 of FIG. 1;

DETAILED DESCRIPTION

Figure 1:
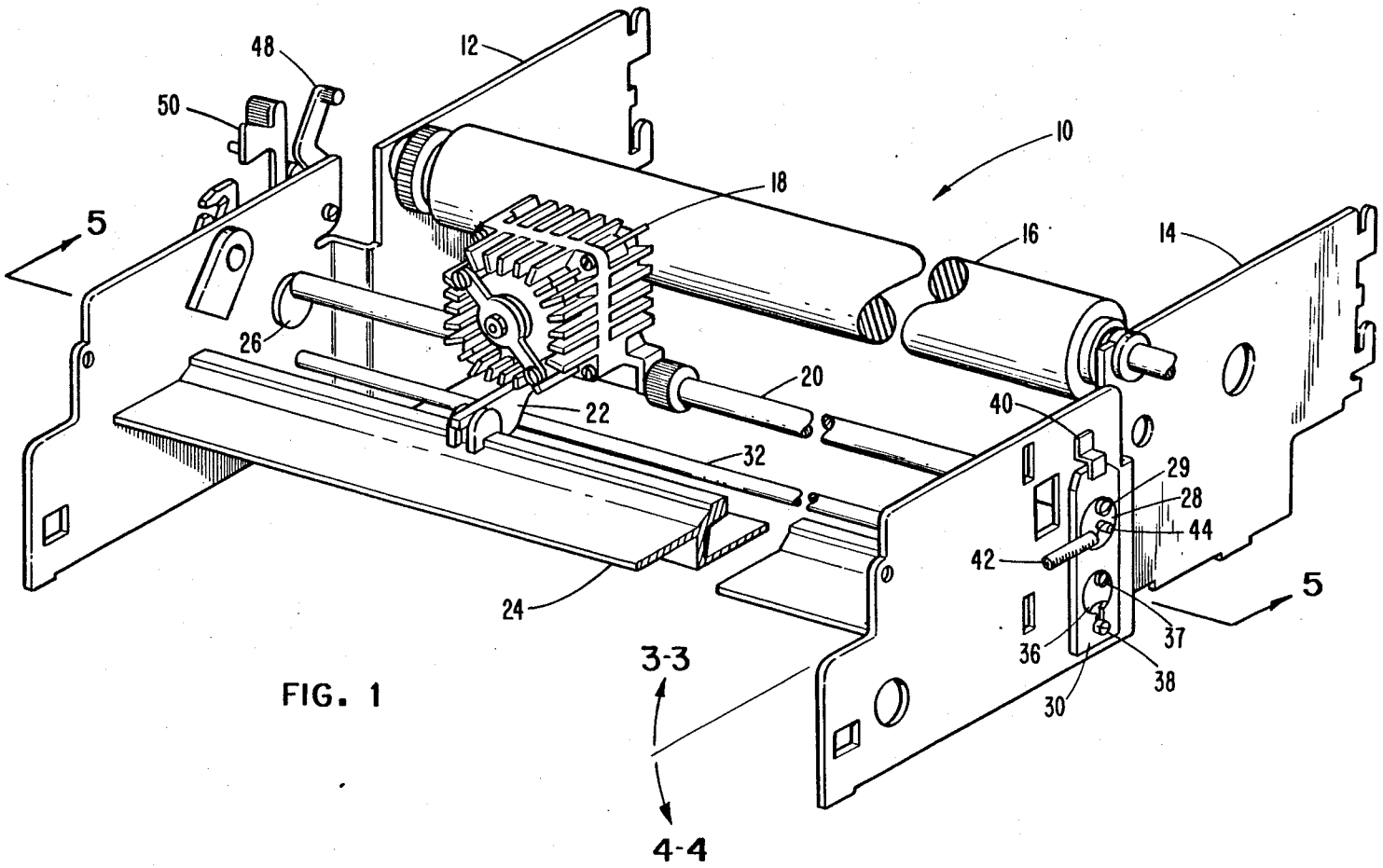
FIG. 1 is a perspective view of a printer assembly embodying features of the present invention.

Referring to FIG. 1, there is shown a printer frame, generally designated 10, having transversely spaced side walls 12 and 14, and a platen 16 rotatably mounted on the frame 10 by means well known in the art.

A removable print head 18 is slidably mounted by conventional means on a guide rod 20 which is located parallel to the platen 16 between the side walls 12 and 14. The print head has an arm 22 which extends away from the back of the print head and engages a guide rail 24 for sliding therealong when the print head is moved across the width of the platen. The guide rail 24 is located parallel to the guide shaft 20 and has its ends frictionally secured to side walls 12 and 14, respectively.

The guide rod 20 is located near the platen 16, has its ends mounted in respective eccentric members 26 and 28 and is secured to the eccentric members by screws 27 and 29, respectively. The members 26 is rotatably mounted in the left side wall 12, while the member 28 is rotatably mounted in a compensator plate 30 which is pivotally attached to the exterior of the right side wall 14.

Figure 8:
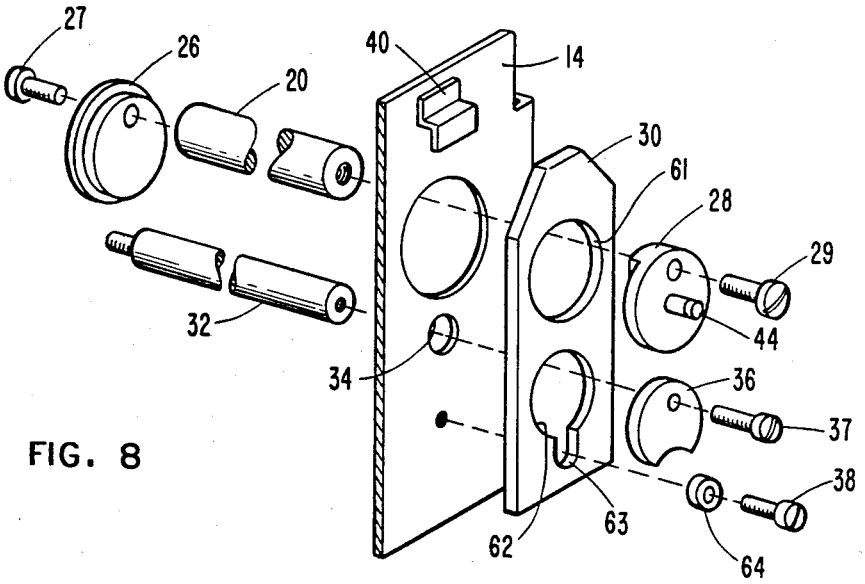
FIG. 8 is an exploded perspective view of certain elements of the present invention.
Figure 9:
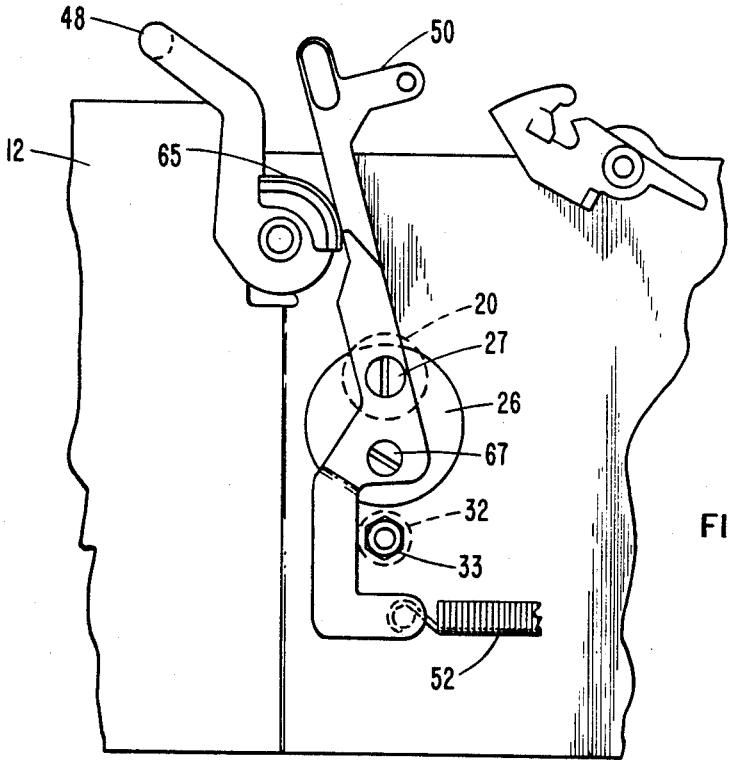
FIG. 9 is a sectional view taken generally along the line 9—9 of FIG. 5.

A compensator rod 32 is positioned between the side walls 12 and 14 a predetermined distance below the guide rod 20 and in a generally parallel relation to the guide rod 20 and the platen 16. One end of the compensator rod is secured to the side wall 12 by a nut 33 as shown in FIG. 9. As best seen in FIG. 8, the other end of the rod 32 passes through an aperture 34 in the side wall 14. The aperture 34 acts as a bearing surface for the rod 32 allowing a minimum clearance so that the rod 32 may be freely rotated. The end of the rod 32, after passing through the aperture 34, is positioned either flush with or slightly over flush with the outer surface of the side wall 14 and has an eccentric member 36 frictionally secured to it. A screw 37 attaches the end of the rod 32 to the member 36.

The compensator plate 30 has openings 61 and 62 which rotatably hold the eccentric members 28 and 36, respectively. Additionally, the plate 30 has an elongated opening 63 which is adapted to receive a bushing 64. The bushing 64 is rotatably mounted on a screw 38 and is used to establish the initial gap between the platen 16 and the print head.

A bracket 40 retains the top of the compensator plate 30 against the side wall 12 to prevent movement of the plate away from the side wall 14. A spring 42 is positioned between a pin 44, which extends from a central portion of the eccentric member 28, to a bracket 46, best seen in FIG. 6. The spring 42 biases the eccentric member 28 which has one end of the guide rod 20 secured thereto.

The elements positioned on the exterior of the side wall 12 are best seen in FIG. 9, and include a print head pull back lever 50 which is used to rotate eccentric member 26 thereby moving print head 18 toward or away from the platen 16 which allows placement of a record medium (not shown) on the platen 16 and of a printer ribbon (not shown) between the record medium and the print head. The pull back lever 50 is biased by a spring 52 which holds the lever 50 against a camming surface 65 located on a copy adjustment lever 48 used to adjust the printing gap. As discussed heretofore, the eccentric member 26 is rotatably mounted in the side wall 12 and holds one end of the guide rod 20. Screw 27 which secures one end of guide rod 20 to the eccentric member 26 also secures lever 50 to the member 26. A screw 67 also secures lever 50 to the eccentric member 26 to prevent rotation of lever 50 around the screw 27.

Figure 2:
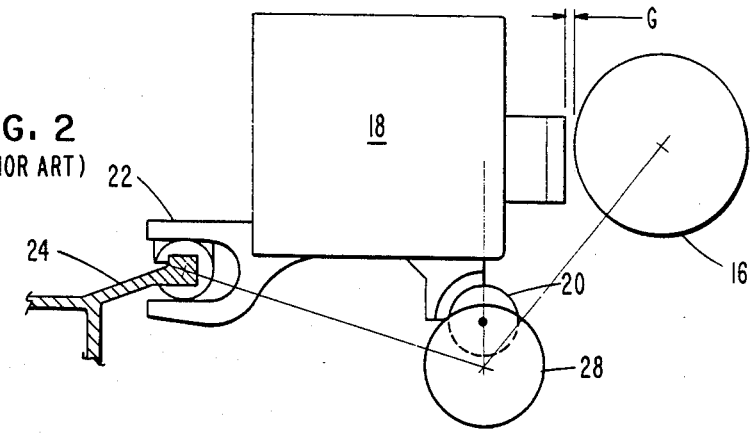
FIG. 2 (PRIOR ART)
FIGS. 2–4 are schematic diagrams illustrating the gap between the print head and the platen of the printer assembly without utilization of the features of the present invention.
Figure 3:
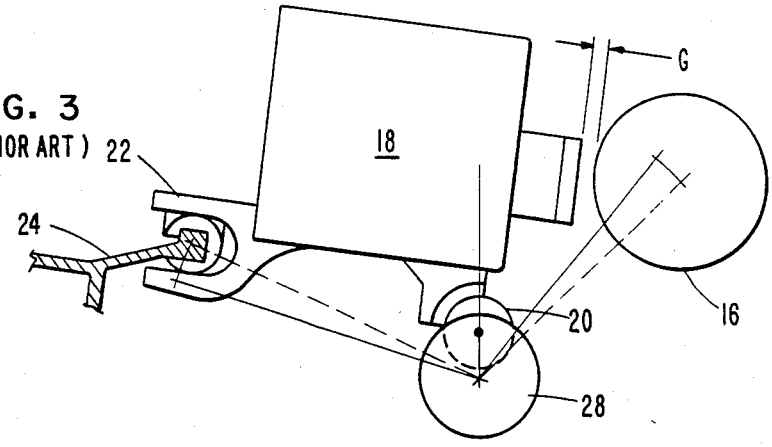
FIG. 3 (PRIOR ART)
Figure 4:
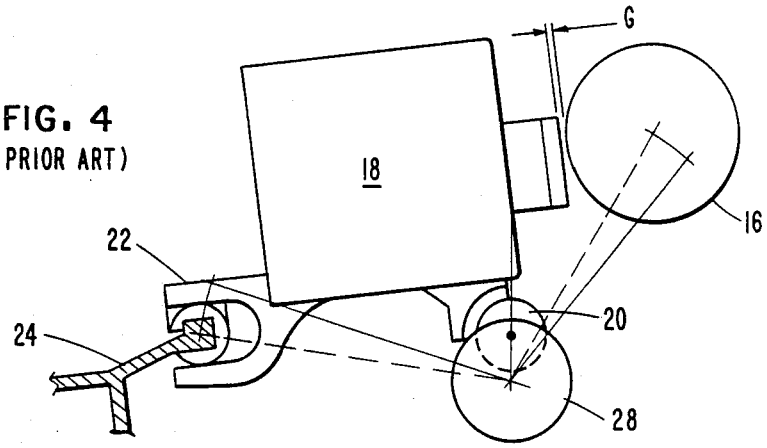
FIG. 4 (PRIOR ART)
Figure 5:
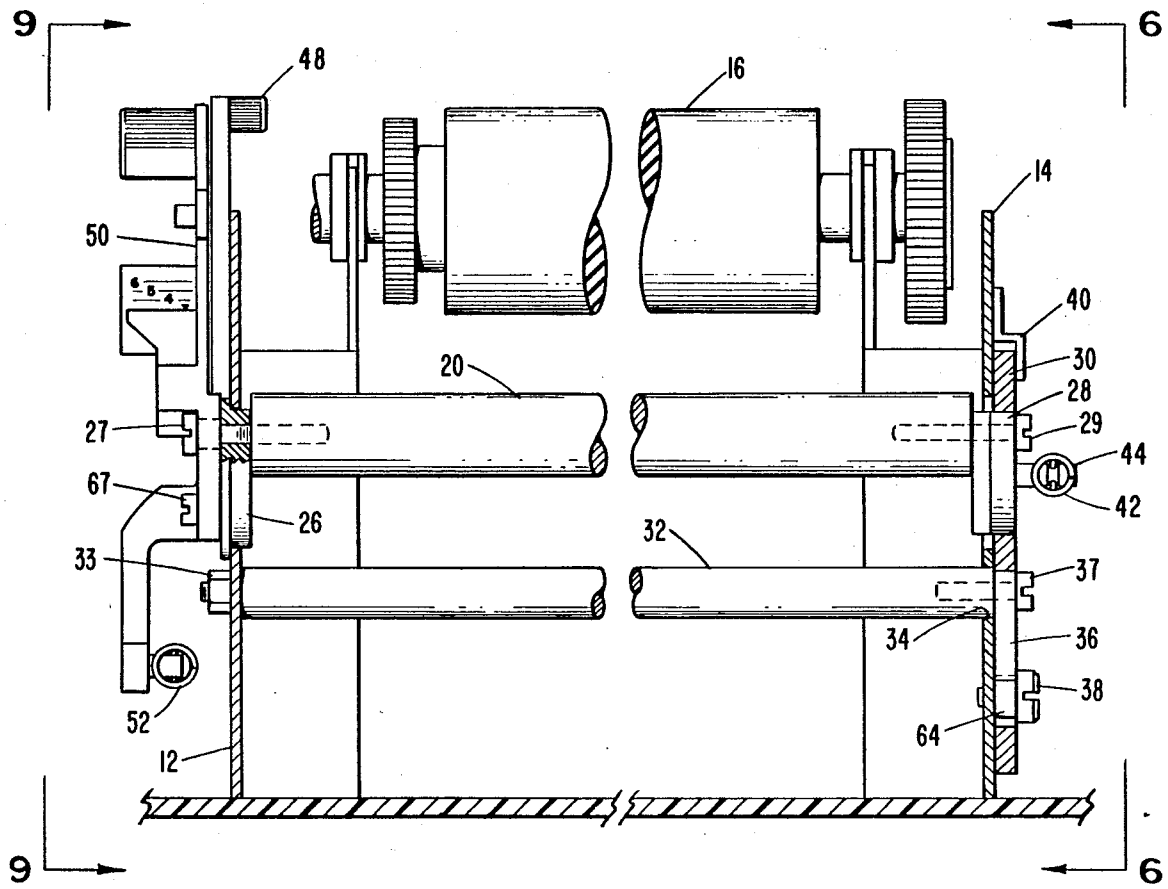
FIG. 5 is a front elevational, sectional view taken generally along the line 5—5 of FIG. 1.

Referring now to FIGS. 2–4, there are shown various print head 18 to platen 16 relationships affecting the printing gap G therebetween without the use of the gap compensating mechanisms of the present invention e.g. there is no compensator plate 30 and the eccentric member 28 is rotatably mounted in the side wall 14.

FIG. 2 illustrates an idealized situation when the printer frame 10 is located on a perfectly flat surface (not shown) such that there is no skewing—relative motion between the two side walls 12 and 14. In this situation, the printing gap G remains constant as the print head 18 traverses across the width of platen 16.

FIG. 3 illustrates the case when the side wall 14 is skewed or rotated in a clockwise direction aline line 3—3 of FIG. 1 with the side wall 12 being fixed. Because the guide rod 20 is secured to eccentric member 28 which is rotatably mounted in the side wall 14, rotation of the side wall 14 and of the ends of the guide rail 24 and platen 16, both of which are secured to the side wall 14, takes place around the center of eccentric member 28. Print head 18, however due to movement of guide rail 24 which supports arm 22 of the print head, rotates around the center of guide rod 20. The result of rotation about different points is that the gap G increases as print head 18 traverses the width of the platen 16 towards side wall 14.

When the side wall 14 is skewed in the direction 4—4 of FIG. 1, rotation of the platen 16, guide rail 24, and print head 18 takes place in the counter clockwise direction. The result is that the gap G decreases as the print head 18 traverses the width of the platen 16 towards side wall 14.

Figure 7:
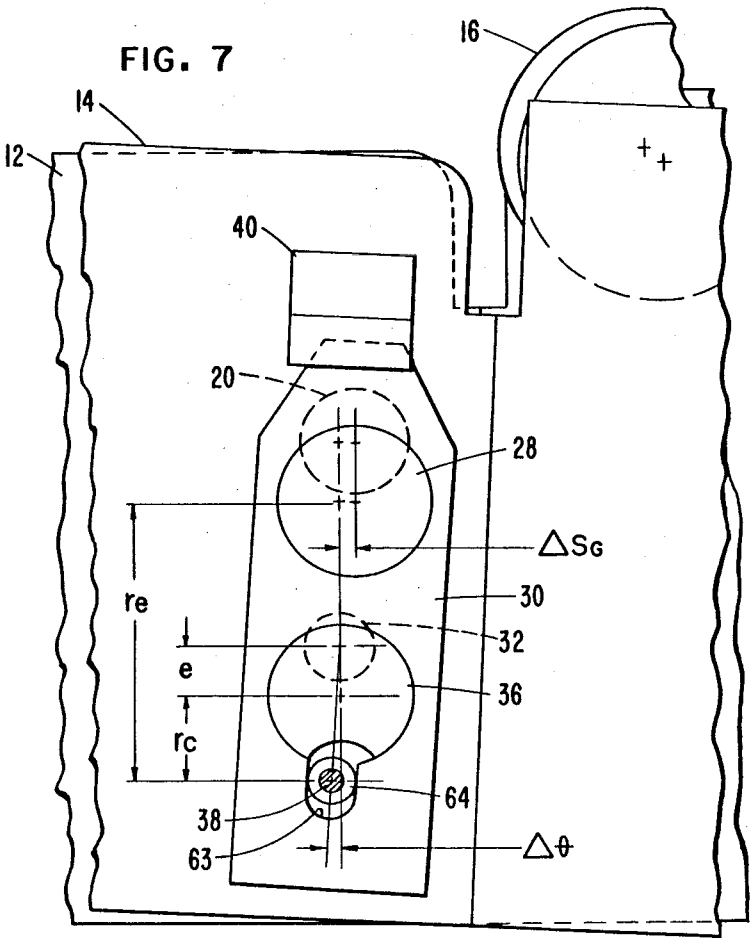
FIG. 7 is a side elevational view similar to FIG. 6, but illustrating distored condition.
Figure 6:
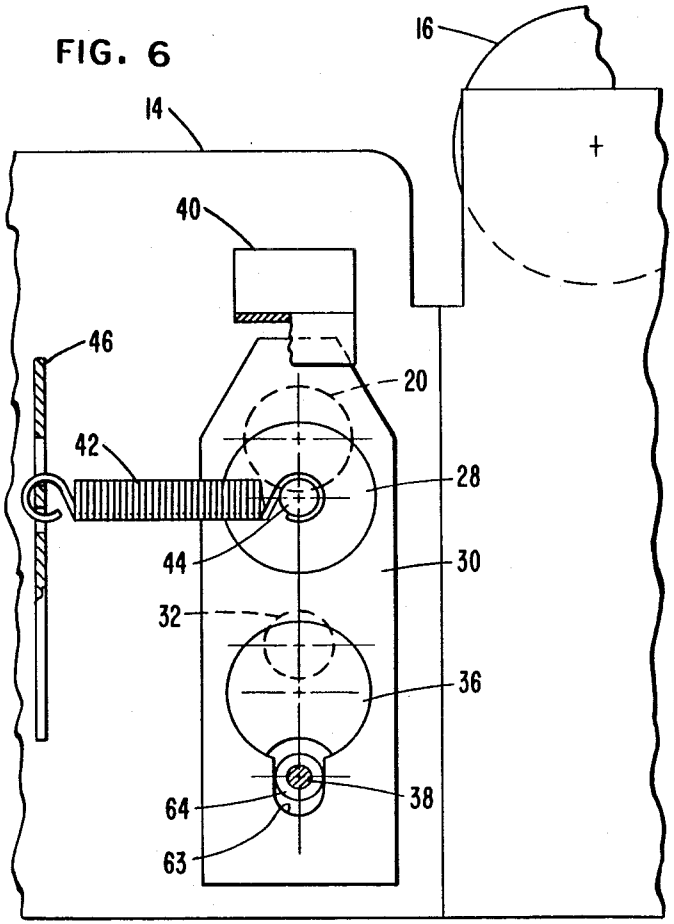
FIG. 6 is a sectional view taken generally along the line 6—6 of FIG. 5.

Referring now to FIGS. 6 and 7, which relate to FIGS. 2 and 3 respectively, but show utilization of the present invention, it will be seen that FIG. 6 illustrates a situation when the printer is on a flat surface and there is no relative motion between the two side walls 12 and 14. The center points of guide shaft 20 and eccentric member 28 are in alignment as was the case as shown in FIG. 2. Additionally, the centers of the compensator rod 32, eccentric member 36, and the pivot point of the compensator plate 30 are also in alignment with the centers of the guide shaft 20 and eccentric member 28.

FIG. 7 illustrates how the gap compensator mechanism operates to maintain a constant printing gap when the side wall 12 is fixed and the side wall 14 is rotated clockwise along line 3—3 of FIG. 1. This, of course, is equivalent to keeping the side wall 14 fixed and rotating side wall 12 counter-clockwise. Side wall 14 rotates about the eccentric member 28 which is rotatably mounted in the compensator plate 30 while the print head 18 rotates about the guide rod 20. Again, just like in the discussion relating to FIG. 3 when the eccentric member 28 was mounted in side wall 14, the gap G will increase as the print head 18 traverses the width of the platen 16 for the same reasons as discussed previously. Side wall 14, however, also rotates about the compensator rod 32, while the compensator plate 30 rotatably attached to the side wall 14 at pivot point 38 rotates about the eccentric member 36 which is secured to the compensator rod 32. Compensator plate 30 rotates about the eccentric member 36 through an angle $\Delta\theta$ which is equal to the angle of skew between the two side walls. Rotation of the compensator plate 30, about the eccentric member 36, moves the eccentric member 28 and the guide rod 20 attached to it a distance $\Delta S_G$ whereby the portion of the guide rod 20 near the side wall 14 is moved closer to the platen 16 thereby cancelling the increase in the gap G due to skewing between the side walls 12 and 14.

For angles of skew between the side walls of 2 degrees or less, which is what a printer frame may be subjected to in normal use in the field, the following relationship gives a sufficiently good approximation to determine the placement for the centers of the compensator rod 32, eccentric members 28 and 36, and the pivot point 38 for the compensator plate 30:

$$\Delta S_G = \frac{(r_e)(e)(\Delta\theta)}{r_c}$$

where, $\Delta S_G$ is the distance the eccentric member 28 is displaced to compensate for the gap G increase or decrease due to skew between the side walls; ($\Delta S_G$ can be determined experimentally or calculated using the relationships shown in FIGS. 3 and 4.)

$r_e$ is the distance between the center of eccentric member 28 and the pivot point of compensator plate 30;

$r_c$ is the distance between the center of eccentric member 36 and the pivot point of compensator plate 30;

e is the distance between the center of eccentric member 36 and the center of compensator rod 32;

$\Delta\theta$ is the angle of skew between side walls 12 and 14 in radians.

What is claimed is:

1. A serial printer comprising:

a print head for printing characters on a record medium;

first and second spaced apart side walls, said second wall having first and second apertures extending therethrough;

a first eccentric member rotatably mounted in said first side wall;

a platen for supporting said record medium located between said side walls;

a guide rod and a guide rail located between said side walls and positioned substantially parallel to said platen for slidably supporting said print head across said record medium, said print head having a first opening through which said guide rod passes and having an elongated second opening which slidably accommodates said guide rail;

an elongated plate pivotally mounted on the outside surface of said second side wall;

second and third eccentric members rotatably mounted in said plate;

said guide rod passing through said first aperture in said second wall having its ends secured to said first and second eccentric members respectively;

means for establishing and varying a printing gap between said print head and said platen; and means for sensing and compensating for skewing which may occur between said side walls when said printer is positioned on an uneven surface.

2. A serial printer in accordance with claim 1, wherein said sensing and compensating means includes a compensator rod located substantially parallel to and below said guide rod, said compensator rod being rotatably supported in said second aperture of said second side wall and having its ends secured to said first side wall and said third eccentric member, respectively.

3. A serial printer in accordance with claim 2, wherein the centers of said second and third eccentric members and the center of the pivot point of said plate lie along the longitudinal axis of said plate.

4. A serial printer in accordance with claim 3, wherein for small angles of skew between the two side walls the relationship between said compensator rod, second and third eccentric members and the pivot point of said plate is given by the following relationship:

$$\Delta S_G = \frac{(r_e)(e)(\Delta\theta)}{r_c}$$

where:

$\Delta S_G$ is the distance in inches said second eccentric member is displaced to compensate for the skew between said side walls;

$r_e$ is the distance in inches between the center of said second eccentric member and the pivot point of said plate;

$r_c$ is the distance in inches between the center of said third eccentric member and the pivot point of said plate;

e is the distance in inches between the center of said third eccentric member and the center of said compensator rod; and $\Delta\theta$ is the angle of skew in radians between said side walls.

5. A serial printer in accordance with claim 1, wherein said printing gap varying means includes a pull-back lever secured to said first eccentric member for rotating the same.

6. A serial printer in accordance with claim 5 wherein said printing gap establishing means includes:

a copy lever including a camming surface rotatably mounted on the outside surface of said first side wall; and means for biasing said pull-back lever against said camming surface.

7. A print head for printing characters on a record medium;

first and second spaced apart side walls, said second wall having first and second apertures extending therethrough;

a first eccentric member rotatably mounted in said first side wall;

a platen for supporting said record medium located between said side walls;

a guide rod and a guide rail located between said side walls and positioned substantially parallel to said platen for slidably supporting said print head across said record medium, said print head having a first opening through which said guide rod passes and having an elongated second opening which slidably accommodates said guide rail;

an elongated plate pivotally mounted on the outside surface of said second side wall;

second and third eccentric members rotatably mounted in said plate;

said guide rod passing through said first aperture in said second wall having its ends secured to said first and second eccentric members respectively;

a pull-back lever for varying the distance between the print head and the platen said lever being secured to said first eccentric member for rotation therewith;

a copy lever including a camming surface rotatably mounted on the outside surface of said first side wall;

a spring for biasing said pull-back lever towards said camming surface establishing a printing gap between said print head and said platen; and a compensator rod for sensing and compensating for skewing which may occur between said side walls, said compensator rod located substantially below said first guide rod and being rotatably supported in said second aperture of said side wall, said compensator rod having one of its ends secured to said first side wall and having its other end secured to said third eccentric member.

8. A serial printer comprising:

a print head for printing characters on a record medium;

first and second spaced apart side walls;

a platen for supporting said record medium located between said side walls;

means for slidably supporting said print head across said record medium;

means for establishing and varying a printing gap between said print head and said platen; and means for sensing and compensating for skewing which may occur between said side walls when said printer is positioned on an uneven surface.

* * * * *

UNITED STATES PATENT AND TRADEMARK OFFICE

CERTIFICATE OF CORRECTION

PATENT NO. : 4,787,759

DATED : November 29, 1988

INVENTOR(S) : David G. Geis, Kurt Rothlisberger

It is certified that error appears in the above-identified patent and that said Letters Patent is hereby corrected as shown below:

Column 3, line 4, "members" should read --member--,
line 60, "mechanisms" should read --mechanism--,
Column 4, line 2, "aline" should read --along--.

In the claims, Column 7, claim 7, line 1, after "aperture of said" insert --second--.

Signed and Sealed this

Eighth Day of May, 1990

*Attest:*

HARRY F. MANBECK, JR.

*Attesting Officer*

*Commissioner of Patents and Trademarks*